US005677957A

United States Patent [19]

Hulsebus

[11] Patent Number: 5,677,957

[45] Date of Patent: Oct. 14, 1997

[54] AUDIO CIRCUIT PRODUCING ENHANCED AMBIENCE

[76] Inventor: Alan Hulsebus, 832 3rd Ave. #1, Excelsior, Minn. 55331

[21] Appl. No.: 554,936

[22] Filed: Nov. 13, 1995

[51] Int. Cl.[6] ..... H04R 5/00

[52] U.S. Cl. ..... 381/1; 381/17; 381/18; 381/21

[58] Field of Search ..... 381/1, 10, 21, 381/24, 17, 18, 19, 20, 27

[56] References Cited

U.S. PATENT DOCUMENTS

| | | | |
|---|---|---|---|
| 3,249,696 | 5/1966 | Van Sickle | 179/1 |
| 3,697,692 | 10/1972 | Hafler | 179/1 G |
| 3,849,600 | 11/1974 | Ohshima | 179/1 G |
| 3,892,624 | 7/1975 | Shimada | 179/1 G |
| 3,921,104 | 11/1975 | Gundry | 333/28 R |
| 3,932,819 | 1/1976 | Spencer | 328/167 |
| 3,949,325 | 4/1976 | Berkovitz | 333/28 R |
| 3,997,725 | 12/1976 | Gerzon | 381/21 |
| 4,024,344 | 5/1977 | Dolby et al. | 179/1 G |
| 4,074,083 | 2/1978 | Berkovitz et al. | 179/100.1 TD |
| 4,087,629 | 5/1978 | Atoji et al. | 179/1 G |
| 4,118,599 | 10/1978 | Iwahara et al. | 179/1 G |
| 4,139,728 | 2/1979 | Haramoto et al. | 179/1 G |
| 4,239,937 | 12/1980 | Kampmann | 179/1 G |
| 4,308,423 | 12/1981 | Cohen | 381/1 |
| 4,355,203 | 10/1982 | Cohen | 179/1 G |
| 4,394,537 | 7/1983 | Shima et al. | 179/1 G |
| 4,700,389 | 10/1987 | Nakayama | 381/1 |
| 4,866,774 | 9/1989 | Klayman | 381/1 |
| 5,046,097 | 9/1991 | Lowe et al. | 381/17 |
| 5,197,100 | 3/1993 | Shiraki | 381/27 |
| 5,412,731 | 5/1995 | Desper | 381/1 |
| 5,414,774 | 5/1995 | Yumoto | 381/1 |
| 5,572,591 | 11/1996 | Numazu et al. | 381/1 |

FOREIGN PATENT DOCUMENTS 55-35582 3/1980 Japan .

OTHER PUBLICATIONS

"On the Advanced Stereophonic Reproducing System Ambience Stereo", Sakamoto et al., *Audio Engineering Society*, Preprint 1361, May 2, 1978.

*Primary Examiner*—Curtis Kuntz
*Assistant Examiner*—Duc Nguyen
*Attorney, Agent, or Firm*—Kinney & Lange, P.A.

[57] ABSTRACT

A circuit for use in connection with a stereo audio system to increase the ambience includes a differencing circuit for receiving a left stereo input and a right stereo input. The differencing circuit produces an output signal having a difference of the left stereo input and the right stereo input. A shelf filtering circuit is operably coupled to the differencing circuit to receive the output signal. The shelf filtering circuit has a first passband range of frequencies wherein the output signal is attenuated at a first level and a second passband range of frequencies wherein the output signal is attenuated at a second level. The shelf filtering circuit has a crossover frequency between the first passband range of frequencies and the second passband range of frequencies. A summing circuit operably coupled to the left input and the right input and operably coupled to the shelf filtering circuit receives an output signal from the shelf filtering circuit. The summing circuit adds a left minus right attenuated output signal from the shelf filtering circuit to the left input and a right minus left attenuated output signal from the shelf filtering circuit to the right input.

17 Claims, 4 Drawing Sheets

AUDIO CIRCUIT PRODUCING ENHANCED AMBIENCE

BACKGROUND OF THE INVENTION

The present invention relates in general to stereo audio systems. More particularly, the present invention relates to a circuit for enhancing the ambience of sound produced by the stereo system.

Although sound may emanate from a single source, the sound perceived by a listener is much more complex. The first sound heard is the direct sound, which comes by line-of-sight from the source. The direct sound arrives unchanged and uncluttered and lasts only as long as the source admits it. The direct sound is received at the ear with a frequency response (tonal quality) more true to the sound produced by the source because it is subject only to losses in the fluid medium (air).

Direct sound, however, is not the only sound that reaches and is heard by the listener. Specifically, the walls of a room and other objects in the room form reflection surfaces from which the direct sound reflects to form complex reflections of sound to the listener. When a recording is made, microphones record both the direct sound and all reflections of sound, which also reach in the microphone. The reflections as a whole are often called "ambience" and help define the room in which the recording is made.

There is an ongoing need to accurately reproduce the ambience recorded in a prior recording so as to give a listener the feel of the room in which the recording was made.

SUMMARY OF THE INVENTION

A circuit for use in connection with a stereo audio system to increase the ambience includes a differencing circuit for receiving a left stereo input and a right stereo input. The differencing circuit produces an output signal having a difference of the left stereo input and the right stereo input. A shelf filtering circuit is operably coupled to the differencing circuit to receive the output signal. The shelf filtering circuit has a first passband range of frequencies wherein the output signal is attenuated at a first level and a second passband range of frequencies wherein the output signal is attenuated at a second level. The shelf filtering circuit has a crossover frequency between the first passband range of frequencies and the second passband range of frequencies. A summing circuit operably coupled to the left input and the right input and operably coupled to the shelf filtering circuit receives an output signal from the shelf filtering circuit. The summing circuit adds a left minus right attenuated output signal from the shelf filtering circuit to the left input and a right minus left attenuated output signal from the shelf filtering circuit to the right input.

DETAILED DESCRIPTION OF THE PREFERRED EMBODIMENTS

Figure 1:
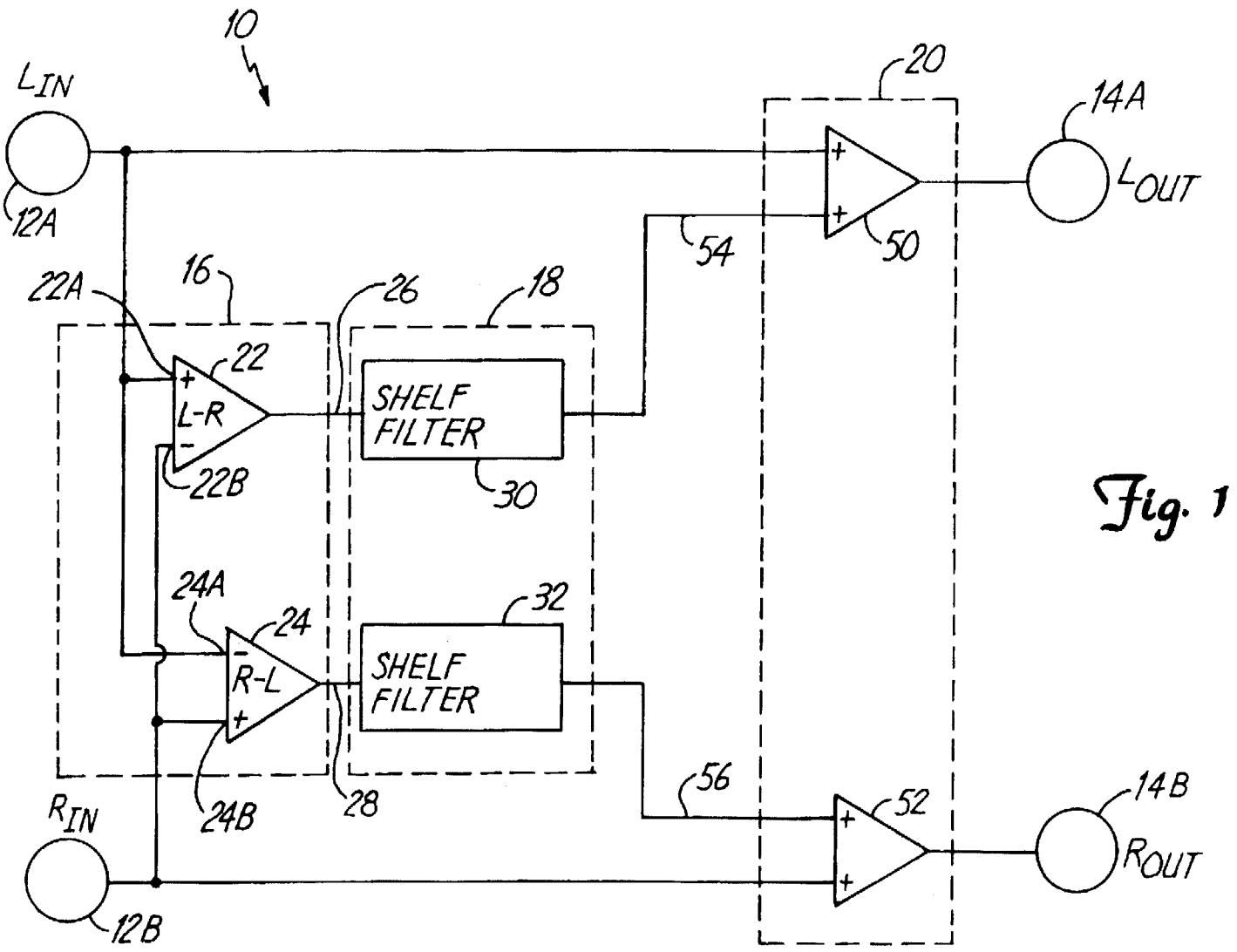
FIG. 1 is a block diagram of a first embodiment of the present invention.

FIG. 1 is a block diagram illustrating a first embodiment of an audio circuit 10 of the present invention. In FIG. 1, reference characters L and R designate left and right channel signals, respectively, of a stereo signal applied to input terminals 12A and 12B. The circuit 10 processes the stereo signal applied to terminals 12A and 12B to enhance the ambience of the stereo signal, providing output signals at output terminals 14A and 14B that can be conditioned by further signal processors such as equalizers, amplifiers, etc., or which can be provided to suitable speakers.

Generally, the circuit 10 includes a differencing circuit indicated at 16, a filtering circuit indicated at 18, and a summing circuit indicated at 20. The differencing circuit 16 is connected to the input terminals 12A and 12B to receive a corresponding left stereo (L) input and a right stereo (R) input. In the embodiment illustrated in FIG. 1, the differencing circuit 16 comprises two differencing amplifiers indicated at 22 and 24. The differencing amplifier 22 has a positive input terminal 22A and a negative input terminal 22B. The positive input terminal 22A is coupled to the left stereo input terminal 12A, while the negative input terminal 22B is coupled to the right stereo input terminal 12B. The differencing amplifier 22 provides an output on signal line 26 corresponding to the left stereo input minus the right stereo input (L–R).

The differencing amplifier 24 also has a negative input at 24A and a positive input at 24B. The negative input 24A is coupled to the left stereo input terminal 12A, while the positive input 24B is coupled to the right stereo input 12B. The differencing amplifier 24 provides an output on signal line 28 corresponding to a signal comprising the right stereo input minus the left stereo input (R–L).

The filtering circuit 18 is operably connected to the differencing circuit 16 to receive the output signals produced therefrom. In the embodiment illustrated in FIG. 1, the filtering circuit 18 includes a first shelf filtering circuit 30 and an identical, second shelf filtering circuit 32. The shelf filtering circuit 30 is coupled to the signal line 26 and receives the (L–R) difference signal produced by the differencing amplifier 22. The shelf filtering circuit 32 is coupled to the signal line 28 and receives the (R –L) difference signal produced by the differencing amplifier 24.

Figure 3:
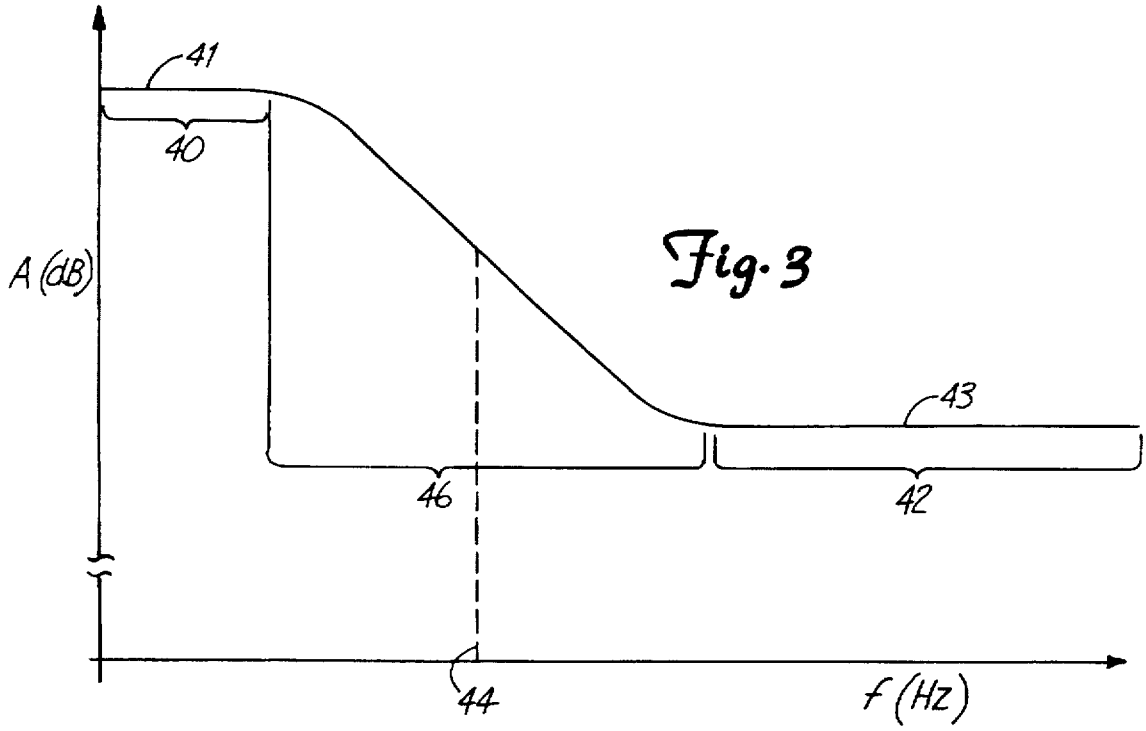
FIG. 3 is a graphical representation indicating levels of attenuation in the circuit of FIG. 1.

The shelf filtering circuits 30 and 32 selectively attenuate frequencies of the (L–R) and (R–L) difference signals. Referring to FIG. 3, an amplitude response of the shelf filtering circuits 30 and 32 is illustrated. The shelf filtering circuits 30 and 32 pass all frequencies and are characterized by two passbands indicated generally at 40 and 42. The first passband 40 attenuates frequency components of the difference signals (L–R) and (R–L) at a first level 41, while the second passband 42 attenuates frequency components of the difference signals (L–R) and (R–L) at a second level 43. The shelf filtering circuits 30 and 32 are also characterized by a crossover frequency indicated at 44 located between the first passband 40 and the second passband 42. The crossover frequency 44 generally denotes the center of a crossover range of frequencies indicated at 46, wherein frequency components of the difference signals (L–R) and (R–L) are at levels between the first level 41 and the second level 43. In a preferred embodiment, the crossover frequency 44 substantially equals 2500 Hz. This frequency is selected because for frequencies less than 2500 Hz a human listener discerns the location of a source of sound based on the phase difference heard by each ear. For frequencies greater than 2500 Hz, the human listener discerns the location of source based on amplitude differences.

In the preferred embodiment, the first level 41 for the first passband 40 is equal to 0 dB, while the second level 43 for the second passband 42 is equal to −3 dB. The shelf filtering circuits 30 and 32 are of first-order having a roll off characteristic in the crossover region 46 equal to −6 dB/Octave. However, it should be understood that the first level 41, the second level 43, the crossover frequency 44 and the roll off characteristic in the crossover region 46 can be adjusted as desired.

Referring back to FIG. 1, the summing circuit 20 comprises two summing amplifiers 50 and 52. The summing amplifier 50 is coupled to the left stereo input 12A and to the shelf filter circuit 30 with signal line 54. The summing amplifier 50 adds the left stereo input to the (L−R) attenuated output signal from the shelf filtering circuit 30, providing a corresponding output signal at the output terminal 14A. Similarly, the summing amplifier 52 is coupled to the right stereo input 12B and the shelf filtering circuit 32 with signal line 56. The summing amplifier 52 adds the right stereo input signal to the (R−L) attenuated output signal from the shelf filtering circuit 32, providing a corresponding output signal at the output terminal 14B.

Figure 2:
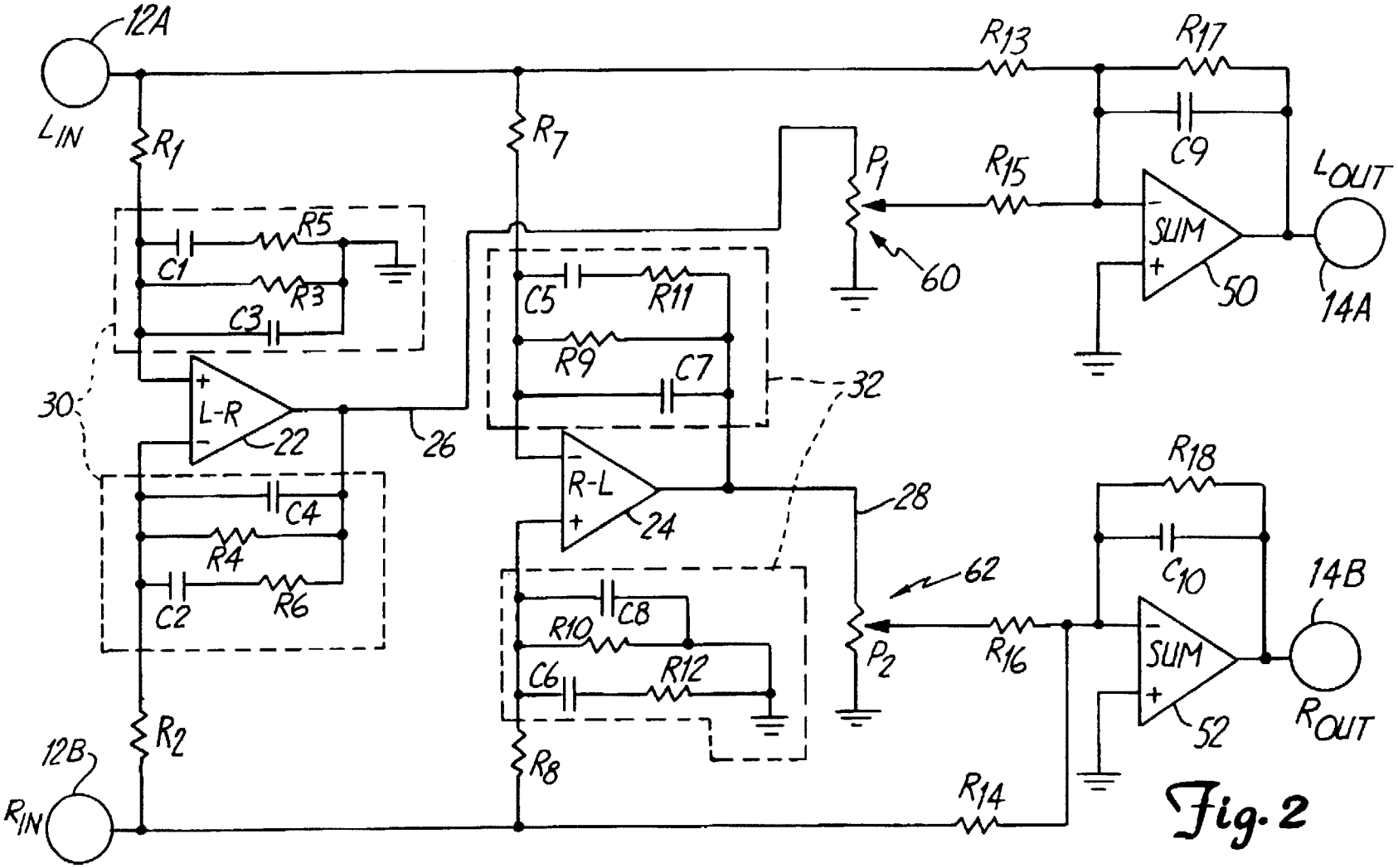
FIG. 2 is a circuit diagram showing a specific implementation of the circuit of FIG. 1.

FIG. 2 is a schematic diagram of the embodiment illustrated in FIG. 1 wherein similar devices have numbered with references described above. In the preferred embodiment, potentiometers 60 and 62 are connected in the signal path for the (L−R) attenuated output signal and the (R−L) attenuated output signal, respectively, to form voltage dividers between the corresponding shelf filtering circuits 30 and 32 and summing amplifiers 50 and 52. The potentiometers 60 and 62 adjust the amount of attenuated output signals that are provided to the summing circuits 50 and 52. Table 1 indicates component tolerance values for the circuit of FIG. 2. Preferably, precision audio grade op amps are used for the amplifiers 22, 24, 50 and 52.

TABLE 1

| | |
|---|---|
| $C_1$, $C_2$, $C_5$, $C_6$ | 0.0022 μF, ratio matched to 1% |
| $C_3$, $C_4$, $C_7$, $C_8$, $C_9$, $C_{10}$ | 100 pF |
| $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{17}$, $R_{18}$ | 10K ohms, ratio matched to 0.05% |
| $R_{15}$, $R_{16}$ | 5K ohms, ratio matched to 0.05% |
| $P_1$, $P_2$ | 10K ohms, ganged |

Figure 4:
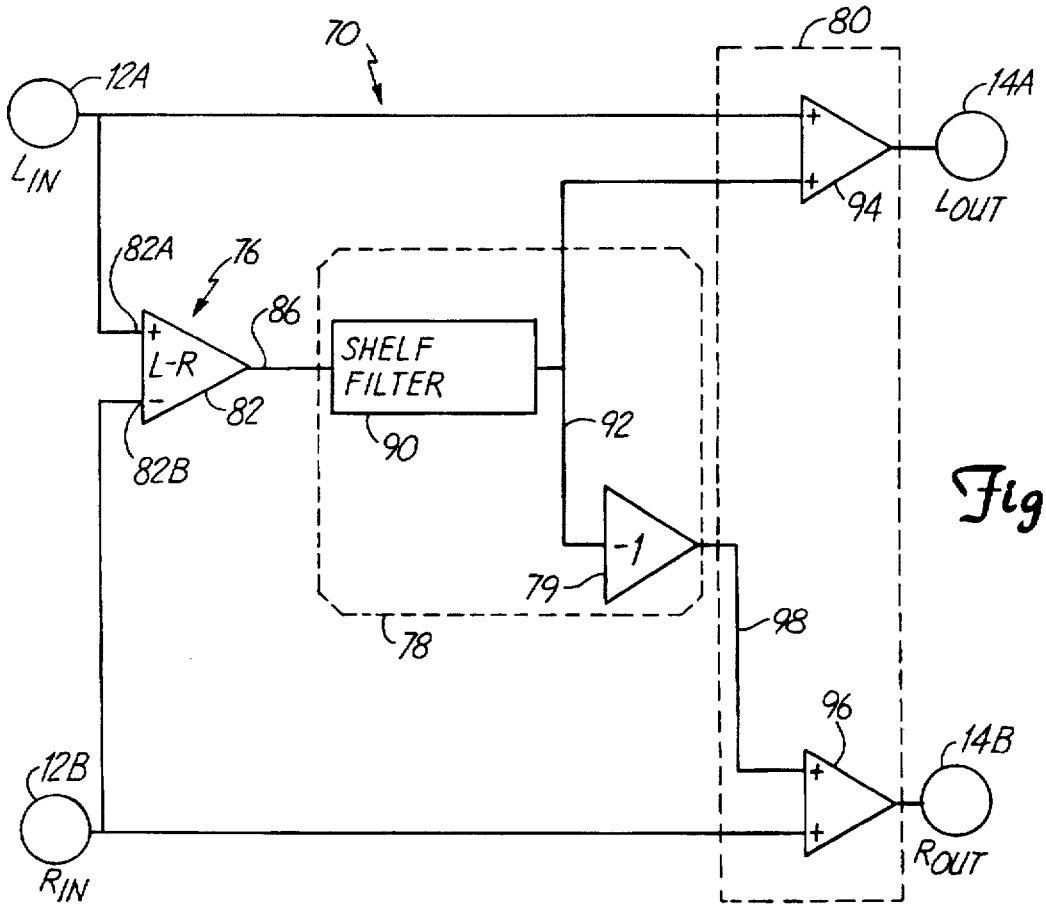
FIG. 4 is a block diagram of a second embodiment of the present invention.

FIG. 4 illustrates a second audio circuit 70 of the present invention. The circuit 70 includes a differencing circuit indicated at 76, a filtering circuit indicated at 78, and a summing circuit indicated at 80. The differencing circuit 76 is connected to the input terminals 12A and 12B to receive a corresponding left and right inputs. In the embodiment illustrated in PIG. 4, the differencing circuit 76 comprises a difference amplifier 82. The difference amplifier 82 has a positive input terminal 82A and a negative input terminal 82B. The positive input terminal 82A is coupled to the left stereo input terminal 12A, while the negative input terminal 82B is coupled to the right stereo input terminal 12B. The differencing amplifier 82 provides an output on signal line 86 corresponding to the left stereo input minus the right stereo input (L−R).

The filtering circuit 78 is operably connected to the differencing circuit 76 to receive the output signal produced therefrom. In the embodiment illustrated in FIG. 4, the filtering circuit 78 comprises a single shelf filtering circuit 90, having the characteristics described above with respect to the shelf filtering circuits 30 and 32, and an inverter 79. The shelf filtering circuit 90 selectively attenuates frequencies of the (L−R) difference signal, providing a corresponding output signal on a signal line 92.

The summing circuit 80 comprises two summing amplifiers 94 and 96. The summing amplifier 94 is coupled to the left stereo input 12A and directly to the shelf filtering circuit 90 with the signal line 92. The summing amplifier 94 adds the left input to the (L−R) attenuated output signal from the shelf filtering circuit 90, providing a corresponding output signal at the output terminal 14A.

As illustrated, the summing amplifier 96 is coupled to the right stereo input terminal 12B and the inverter 79. The inverter 79 receives the (L−R) attenuated output signal from the shelf filtering circuit 30 and inverts the signal to provide a (R−L) attenuated output signal on a signal line 98. The summing amplifier 96 adds the right stereo input signal to the (R−L) attenuated output signal from the inverter 79, providing a corresponding output signal at the output terminal 14B.

Although the circuit of FIG. 4 will increase the ambience of the stereo input received at terminals 12A and 12B, the circuit of FIG. 1 is preferable because the attenuated difference signals (L−R) and (R−L) added to the left channel and the right channel, respectively, at the summing amplifiers 50 and 52, respectively, have approximately the same errors in time, phase, distortion and frequency. This aspect is not found in the circuit of FIG. 4, because of the presence of inverter 79 and the single difference amplifier 82. With respect to the difference amplifier 82, all bipolar and JFET op amps exhibit considerable propagation delay differences between the inverting and noninverting inputs, which results in phase and group delay errors. Stereo imaging is enhanced when each of the respective channels processes the corresponding signals equivalently. Although errors in time, phase, distortion and frequency can exist, as long as the errors are substantially the same, stereo imaging is maintained.

Although the present invention has been described with reference to preferred embodiments, workers skilled in the art will recognize that changes may be made in form and detail without departing from the spirit and scope of the invention.

What is claimed is:

1. A circuit for use in connection with a stereo audio system, the circuit comprising:

a differencing circuit for receiving a left stereo (L) input and a right stereo (R) input and producing an output signal being a difference of the left stereo input and the right stereo input;

a shelf filtering circuit operably coupled to the differencing circuit to receive the output signal, the shelf filtering circuit having a first passband range of frequencies wherein the output signal is attenuated at a first level and a second passband range of frequencies wherein the output signal is attenuated at a second level wherein a crossover frequency of the shelf filter is a frequency between the first passband range of frequencies and the second passband range of frequencies; and a summing circuit operably coupled to the (L) input and the (R) input and operably coupled to the shelf filtering circuit for receiving an output signal from the shelf filtering circuit, the summing circuit adding a (L−R) attenuated output difference signal from the shelf filtering circuit to the (L) input and a (R−L) attenuated output difference signal from the shelf filtering circuit to the (R) input.

2. The circuit of claim 1 wherein the crossover frequency is 2500 Hz.

3. The circuit of claim 1 wherein the differencing circuit comprises:

a first differencing amplifier connected to the (L) input and (R) input for providing a (L–R) difference signal; and a second differencing amplifier connected to the (L) input and the (R) input for providing a (R–L) difference signal.

4. The circuit of claim 3 wherein the shelf filtering circuit comprises:

a first shelf filter connected to the first differencing amplifier for receiving the (L–R) difference signal and for providing the (L–R) attenuated output difference signal; and a second shelf filter connected to the second differencing amplifier for receiving the (R–L) difference signal and for providing the (R–L) attenuated output difference signal.

5. The circuit of claim 4 wherein the summing circuit comprises:

a first summing amplifier for receiving the (L) input and the (L–R) attenuated output difference signal; and a second summing amplifier for receiving the (R) input and the (R–L) attenuated output difference signal.

6. The circuit of claim 5 wherein a difference between the first level and the second level is adjustable.

7. The circuit of claim 5 wherein the crossover frequency is 2500 Hz.

8. The circuit of claim 5 wherein a crossover characteristic between the first level and the second level for a frequency range including the crossover frequency for the first shelf filter and the second shelf filter is –6 dB/octave.

9. A circuit for use with stereophonic audio reproduction apparatus having left and right channel signals comprising:

a differencing circuit for receiving the left and right channel signals and producing an output signal based on a difference of the left and right channel signals;

a shelf filtering circuit operatively coupled to the differencing circuit to receive the output signal, the shelf filtering circuit having a crossover frequency between first and second passband ranges of frequencies, the shelf filtering circuit attenuating the first passband range of frequencies of the output signal at a first level and the second passband range of frequencies of the output signal at a second, different level, the crossover frequency being selected as that frequency above which sound source location is predominately discerned by a listener on the basis of amplitude difference and below which sound source location is predominately discerned by the listener on the basis of phase difference; and a summing circuit operatively connected to the left and right channel signals and to the shelf filtering circuit for receiving the attenuated output difference signal from the shelf filtering circuit, the summing circuit adding an attenuated output difference signal from the shelf filtering circuit to one of the channel signals and an inverted attenuated output difference signal from the shelf filtering circuit to the other channel signal.

10. The circuit of claim 9 wherein a difference between the first level and the second level is adjustable.

11. The circuit of claim 9 wherein the crossover frequency is 2500 Hertz.

12. The circuit of claim 9 wherein a crossover characteristic between the first level and the second level for a frequency range including the crossover frequency for the shelf filtering circuit is –6 dB/octave.

13. The circuit of claim 9 wherein the shelf filtering circuit produces a delay in the output signal consisting essentially of a phase shift.

14. A circuit for use with stereophonic audio reproduction apparatus having left and right channel signals comprising:

a differencing circuit for receiving the left and right channel signals and producing first and second output signals based on the left channel signal minus the right channel signal and the right channel signal minus the left channel signal, respectively;

a shelf filtering circuit operatively coupled to the differencing circuit to receive the first and second output signals, the shelf filtering circuit having a crossover frequency between first and second passband ranges of frequencies, the shelf filtering circuit attenuating the first passband range of frequencies of the first and second output signals at a first level and the second passband range of frequencies of the first and second output signals at a second, different level, wherein any delay introduced to the first and second output signals consists essentially of a phase shift associated with a passive filtering function of the shelf filtering circuit; and a summing circuit operatively connected to the left and right channel signals and to the shelf filtering circuit for receiving the attenuated first and second output difference signals from the shelf filtering circuit, the summing circuit adding the first attenuated output difference signal from the shelf filtering circuit to the left channel signal and the second attenuated output differencing signal from the shelf filtering circuit to the right channel signal.

15. The circuit of claim 14 wherein a difference between the first level and the second level is adjustable.

16. The circuit of claim 14 wherein the crossover frequency is 2500 Hertz.

17. The circuit of claim 14 wherein a crossover characteristic between the first level and the second level for a frequency range including the crossover frequency for the shelf filtering circuit is –6 dB/octave.

* * * * *